US007303420B2

(12) United States Patent
Huch et al.

(10) Patent No.: US 7,303,420 B2
(45) Date of Patent: Dec. 4, 2007

(54) CONNECTING DEVICE FOR A PLUG-AND-SOCKET CONNECTION CONTAINING TWO CONNECTORS

(75) Inventors: Jochen Huch, Mannheim (DE); Reinhard Engert, Heppenheim (DE)

(73) Assignee: Sirona Dental Systems GmbH, Bensheim (DE)

( * ) Notice: Subject to any disclaimer, the term of this patent is extended or adjusted under 35 U.S.C. 154(b) by 0 days.

(21) Appl. No.: 11/540,979

(22) Filed: Oct. 2, 2006

(65) Prior Publication Data

US 2007/0087614 A1 Apr. 19, 2007

(30) Foreign Application Priority Data

Sep. 30, 2005 (DE) ..... 10 2005 047 298

(51) Int. Cl.
*H01R 4/50* (2006.01)

(52) U.S. Cl. ..... 439/341; 439/376

(58) Field of Classification Search ..... 439/326, 439/341, 376

See application file for complete search history.

(56) References Cited

U.S. PATENT DOCUMENTS 3,617,985 A * 11/1971 Kehl ..... 439/341
4,972,296 A * 11/1990 Chu ..... 361/725
5,302,136 A 4/1994 St. Germain et al.
6,083,027 A * 7/2000 Sato ..... 439/341
6,910,911 B2 * 6/2005 Mellott et al. ..... 439/358

FOREIGN PATENT DOCUMENTS

| | | |
|---|---|---|
| DE | 29507560 | 10/1996 |
| DE | 20317751 | 4/2005 |
| DE | 202005006236 | 7/2005 |
| GB | 2127235 | 4/1984 |
| GB | 2203299 | 10/1988 |

* cited by examiner

*Primary Examiner*—Thanh-Tam Le
(74) *Attorney, Agent, or Firm*—Dykema Gossett PLLC

(57) ABSTRACT

A connecting device for a plug-and-socket connection containing two connectors that includes a first part (1) with a first connector (2) and a second part (3) with a second connector (4). The first part (1) is equipped with an axle pin (5), and the second part (3) is equipped an axle bearing (6) for the axle pin (5), wherein the second part (3) is pivotable from a release position to a closed position about an axis of rotation (7) defined by the axle bearing (6), wherein the distance d1 of the center axis (16) of the first connector (2) from the axis of rotation (8) is equal to the distance d2 of the center axis (17) of the second connector (4) from the axis of rotation (8).

12 Claims, 7 Drawing Sheets

CONNECTING DEVICE FOR A PLUG-AND-SOCKET CONNECTION CONTAINING TWO CONNECTORS

TECHNICAL FIELD

The invention relates to a connecting device for a plug-and-socket connection containing two connectors, comprising a first part with a first connector and a second part with a second connector and further relates to the problem of expediently producing a secure plug-and-socket connection without the connectors jamming against each other and becoming permanently deformed.

DESCRIPTION OF THE RELATED ART

Several connecting devices for plug-and-socket connections are disclosed in the prior art.

DE 295 07 560 U1 discloses a dental treatment unit with a holder for a portable accessory device for a dental treatment center. A combined hook-and-plug system is disclosed in an exemplary embodiment. The accessory device has a bar that is hooked into two hooks on the holder. In a depression, the holder has a tiltably-mounted terminal block, which, on the one hand, has sockets for a mechanical adjustment of the accessory device by means of centering pins and, on the other hand, a plug unit. The terminal block is supported in the holder in such a way that it is slightly angled when the device is removed and abuts against a stop when the device is attached, thereby automatically establishing the aforementioned electrical and mechanical connections. The intension is to achieve alignment of the connectors by plugging the centering pins and the sockets together. This suffers from the drawback that an obligatory mechanical play must exist between the pins and the plugs.

Furthermore, with use, it is possible that the relatively thin centering pins may be bent. The inclination of the freely-tiltable terminal block is established solely by plugging the centering pins and the sockets together. Thus the consequence of the mechanical play and the bending of the centering pins would be an imprecise alignment of the connectors.

A plug for achieving a fiber optic connection for a fiber optic cable comprising at least one optical fiber is disclosed in DE 203 17 751 U1. Two plugs on two optical fibers are bilaterally introduced into a double coupler. A catch spring engages after the plug is plugged into the double coupler and secures the plug-and-socket connection by locking. The connection can be unlocked by pressing a rocker arm to release the catch spring.

An electric socket is disclosed in DE 20 2005 006 236 U1. A plug is released from the socket by flipping a control lever toward the socket. The plug-and-socket connection is locked into the socket by flipping the control lever toward the plug.

A disadvantage of plug-and-socket connections disclosed in the prior art is that the connectors must be plugged together manually. If the connectors are not in alignment, they jam and become permanently deformed.

An additional disadvantage is that jamming can also occur during manual disengagement of the plug-and-socket connection.

It is an object of the invention to provide a connecting device for a plug-and-socket connection that ensures a secure and expedient plug-and-socket connection of the connectors, wherein said connectors neither jam nor become permanently deformed.

SUMMARY OF THE INVENTION

According to the invention, this object is achieved by a connecting device as defined in claim 1.

The connecting device of the invention for a plug-and-socket connection containing two connectors comprises a first part with a first connector and a second part with a second connector. The first part is equipped with an axle pin and the second part is equipped with an axle bearing for said axle pin. The second part is capable of being pivoted from a release position to a closed position about an axis of rotation defined by the axle pin. The first part comprises a plate capable of being pivoted about the axis of rotation, against which plate at least some regions of the second part bear. On the one hand, the first connector is longitudinally displaceable along its center axis relatively to the plate by means of a longitudinal guide and, on the other hand, it is subjected to compelled guidance by a positive guide on the first part. The positive guide is configured such that the first connector remains substantially stationary in its longitudinal direction relative to the first part when the plate is pivoted from the release position to the closed position, wherein the distance of the center axis of the first connector from the axis of rotation is equal to the distance of the center axis of the second connector from the axis of rotation.

This assures that the two connectors are in alignment along their center axes when the second part and the plate resting thereon are pivoted toward the first part, and that the two connectors are prevented from jamming or being permanently deformed during the connecting operation.

The connecting device of the invention is well-suited for medical applications, in which secure and error-free plug-and-socket connections are of paramount importance.

The connectors are advantageously electrical contacts. It is thus possible to achieve electrical plug-and-socket connections that are also suitable for everyday use with the advantage that known problems such as loose contacts caused by permanent deformations are avoided.

According to an advantageous development, the connectors are configured as pipe sections for conducting gases or liquids. In this manner a secure sliding socket joint is possible between, say, two pipe sections with the advantage that the two pipe sections are in exact alignment, thus achieving the required seal relative to the environment. Another advantage is that the mechanics of the connecting device of the invention define an insertion distance along which the two pipe sections are connected together. This allows for reproducible conditions and thus the realization of a secure plug-and-socket connection, as is not the case with manual connecting.

The first part is advantageously a stationary part and the second part a removable part, or vice versa. The first as well as the second part can be used as the stationary part.

The first part is advantageously a dental treatment center and the second part a removable accessory device. Especially in dentistry, the security and the longevity of the connecting device of the invention are of paramount importance.

The second part is also advantageously secured against falling out in all intermediate positions between the release position and the closed position in that the lower semicircle of the axle pin is recessed such that the upper semicircle can be inserted into the axle bearing along a longitudinal groove and hooked therein due to the weight of the second part, which is pushed downwardly to produce a form fit with the upper part of the axle bearing being in the form of a segment of a circle. The advantage of this form fit is that no other mechanical means are necessary for locking other than the two parts of the connecting device and that locking is accomplished as soon as the two parts are joined together, and no further expenditure of time is required.

The plate is advantageously braced against the first part by means of a biased spring element. This ensures that, when the two parts are separated, the plate is pivoted outwardly from the first part through the angle a and that in the plugged state, the plate is always pressed against the contact surface of the second part as it pivots to the intermediate position.

A rotation stop is advantageously provided for the action of pivoting the plate toward the first part, said stop being configured such that the plate is only capable of being pivoted through an angle a in the release position. In this manner, the maximum angle a for pivoting can be defined such that the necessary insertion distance is achieved precisely. Unnecessary pivoting past the angle a is thus prevented. The angle of the first part to the second part must therefore be at least as large as the angle a when the upper semicircle of the axle pin is inserted into the axle bearing along the longitudinal groove, in order to prevent the axle pin from falling out.

The axis of rotation is advantageously eccentric relative to the center axes of the two connectors. The greater the distance between the axis of rotation and the center axes of the two connectors, the smaller the angle a must be in order to create the required insertion distance for pivoting.

Locking means are advantageously provided, by means of which the second part is preventing from pivoting back when the closed position is reached. This ensures that the two parts are immovably fixed to each other and that the two connectors remain closely connected.

The tension of the spring element is advantageously such that the plate is pivoted through the angle a from the closed position to the release position. The tension of the spring element must therefore be greater than the counter-force generated during pivoting, such as friction on the axle pin and the perpendicular components of the weight of the plate.

BRIEF DESCRIPTION OF THE DRAWING

An exemplary embodiment of the invention is represented in the drawings, in which.

DETAILED DESCRIPTION OF EXEMPLARY EMBODIMENTS OF THE INVENTION

Figure 1:
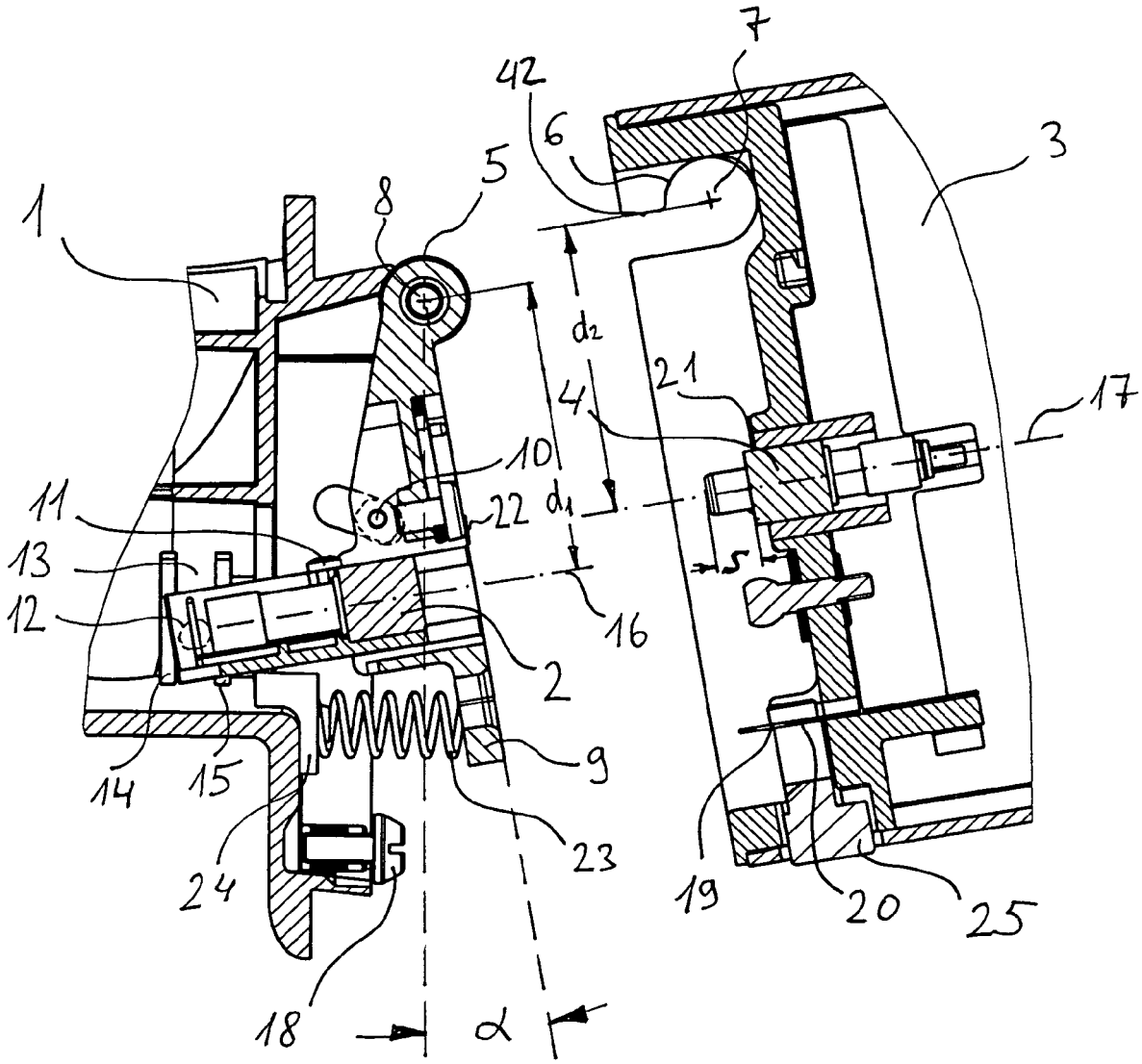
FIG. 1 shows the connecting device with two parts in the separated state.

The connecting device represented in FIG. 1 has a first part 1 with a first connector 2 and a second part 3 with a second connector 4. The first part 1 is equipped with an axle pin 5 and the second part 3 has an axle bearing 6 for said axle pin 5. The second part 3 is capable of being pivoted about an axis of rotation 7 defined by the axle bearing 6, which axis coincides with the center axis 8 of the axle pin 5 in the plugged state of the connecting device. The axle pin 5 is cylindrically configured and in the plugged state it is located inside the axle bearing 6.

Furthermore, the first part 1 comprises a plate 9 that is likewise capable of being pivoted about the center axis 8, wherein a rotation stop 10 prevents pivoting beyond an angle a. Pivoting and thus the effort expended by a user in fixing the second part 3 onto the first part 1 is thus restricted to the absolutely necessary amount.

The angle a is such that a maximum insertion distance is created as the plate 9 pivots, which maximum insertion distance is greater than the minimum distance required to connect the two connectors 2 and 4 together. A frame or other suitable component capable of being pivoted about the center axis 8 can be substituted for the plate.

On the one hand, the first connector 2 is longitudinally displaceable relative to the plate 9 along a longitudinal guide 11 and on the other hand it is subjected to compelled guidance by a positive guide 13 on the first part 1 via a guide pin 12.

The positive guide 13 is of linear design and comprises two ribs 14 and 15, between which and alongside of which the guide pin 12 slides. The positive guide 13 forces the guide pin 12 to rotate about the axis 8 as the plate 9 is pivoted; in other words to move along a linear path between the ribs 14 and 15. The result thereof is that the first connector 2 is not pivoted together with the plate but is rather subjected to an opposing force from the rib 14 and moved relatively to the plate 9 within the longitudinal guide 11.

A center axis 16 of the first connector 2 is at a distance d1 from the center axis 8, and the center axis 17 of the second connector 4 is at a distance d2 from the axis of rotation 7. The longitudinal guide 11 is mounted on the plate 9 such that the connector 2 is displaceable along the center axis 16.

A locking bolt 18 is configured so that it narrows conically in an outward direction and is thus capable of engaging in an opening 19 on a locking plate 20 on the second part 3.

The second part 3 comprises a contact surface 21 that bears against a contact surface 22 on the pivotally mounted plate 9 in the plugged state of the connecting device.

Due to the longitudinal guide 11 and the fact that the distances d1 and d2 are equal, it is ensured that the two connectors 2 and 4 are in alignment in the plugged state. To this end, the longitudinal guide 11 guides the first connector 2 at a distance d1 perpendicular to the plate 9, whilst the second connector 4 is guided at a distance d2 perpendicular to the contact surface 21 and thus also to the plate 9 adjacent thereto. The center axes 16 and 17 of the two connectors are at least parallel to each other. Because the distances d1 and d2 are equal, the center axes 16 and 17 coincide.

A spring element 23 is disposed between the plate 9 and a bearing piece 24 on the first part 1. In the release position, said spring element 23 is in a pre-stressed state. The spring tension induced by the biased spring element 23 is large enough to press the plate 9 away from the first part 1 and to move it through the angle a defined by the rotation stop 10. In positions that will be explained below, the plate 9 is pivoted against the spring tension of the spring element 23 toward the first part 1.

Figure 2:
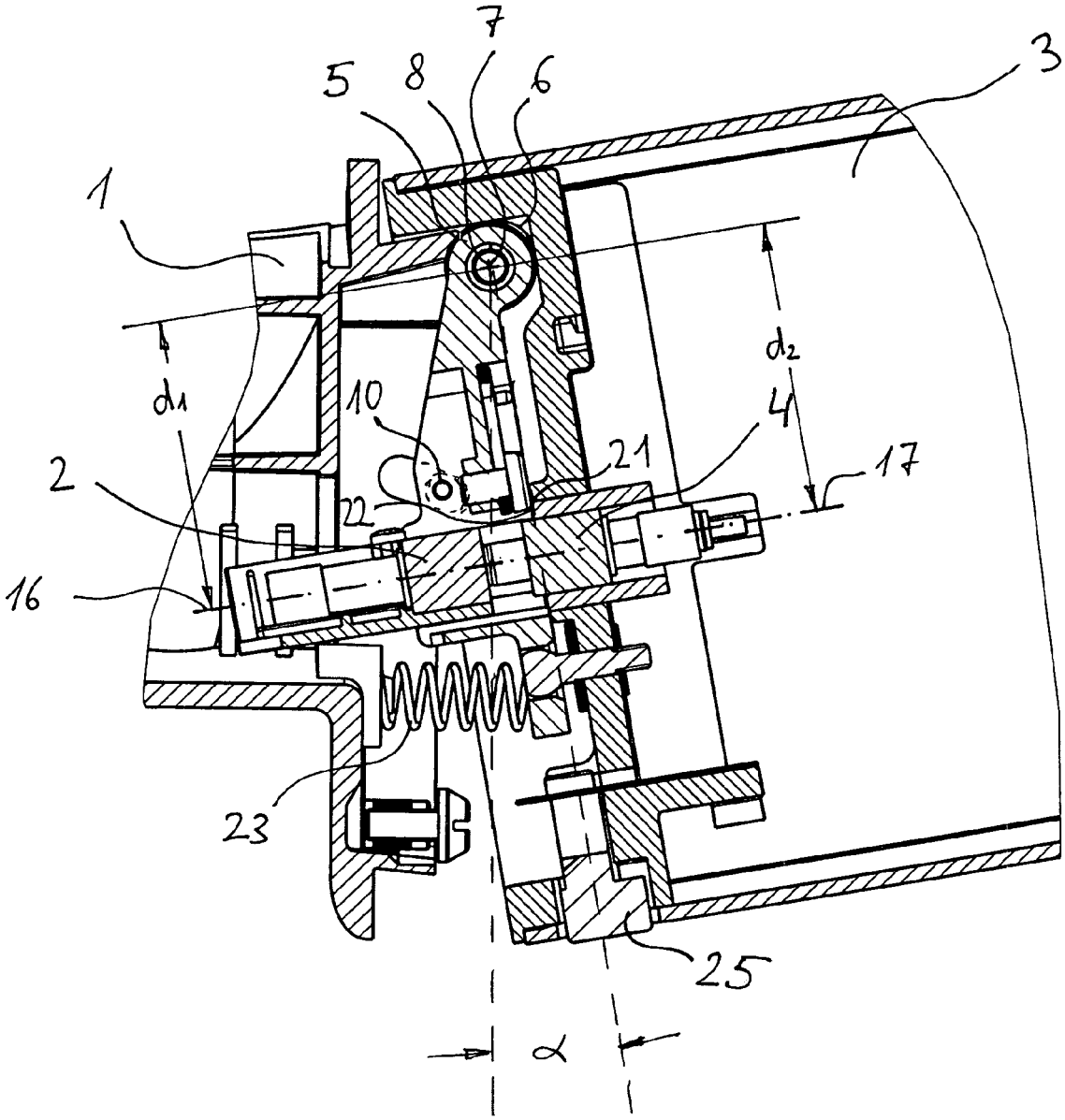
FIG. 2 shows the connecting device with of the two parts in a release position.

The connecting device represented in FIG. 2 is in a release position, i.e., the first and second connectors 2 and 4 are in contact with each other and the plate 9 is still completely unpivoted, as illustrated in FIG. 1. The second part 3, which is capable of being pivoted about the axis of rotation 7, is pivoted toward the first part 1 through an angle a defined by the rotation stop 10. Because the axle pin 5 is accommodated in the axle bearing 6, the center axis 8 of said axle pin 5 and the center axis 7 coincide. The distance d1 of the center axis 16 of the first connector 2 from the center axis 8 of the axle pin 5 is equal to the distance d2 of the center axis 17 of the second connector 4 from the axis of rotation 7.

The second part 3 bears with the contact surface 21 against the contact surface 22 of the pivotally mounted plate 9. Even in this position, the first connector 2 is in alignment with the second connector 4.

Figure 3:
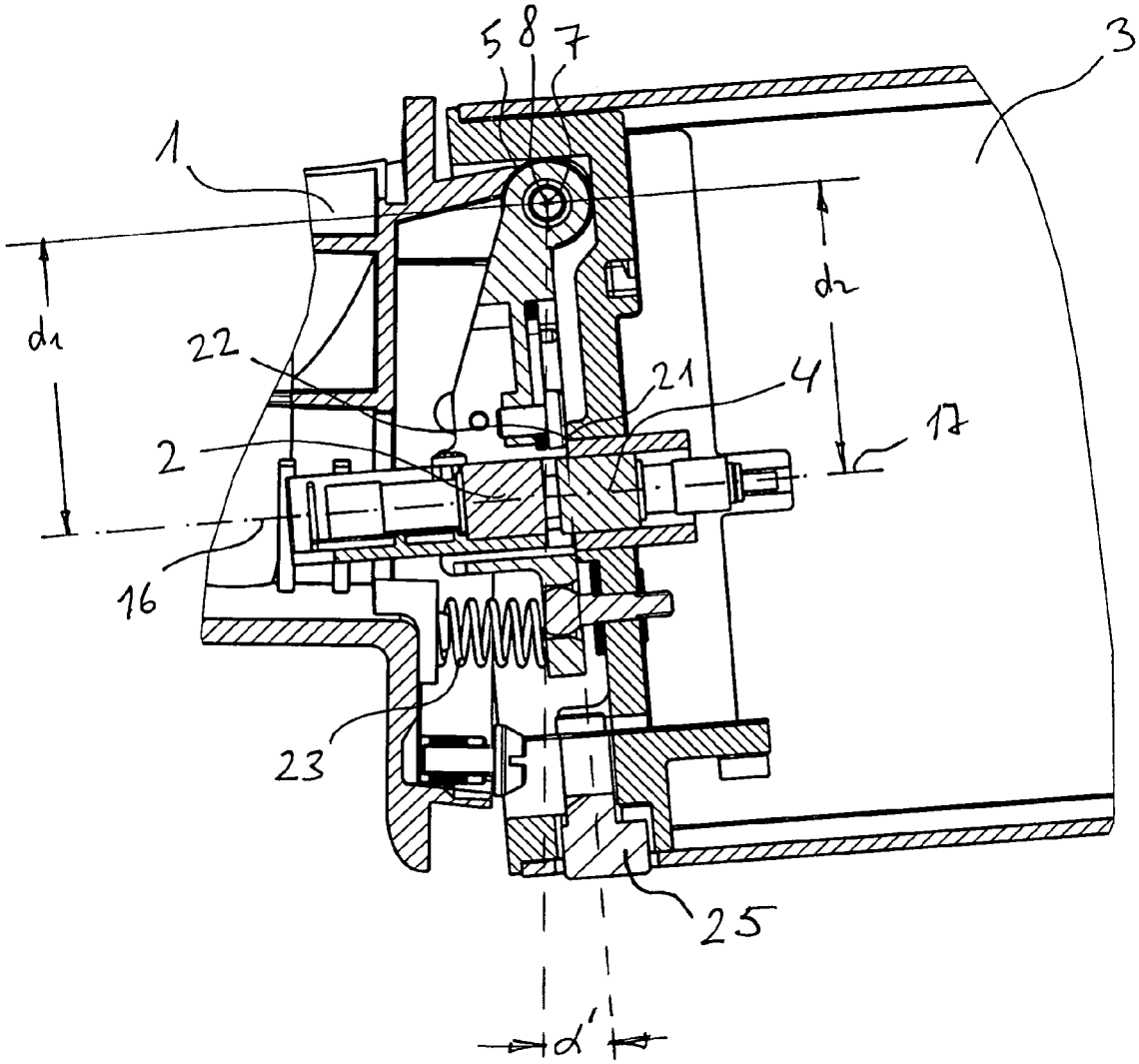
FIG. 3 shows the connecting device with of the two parts in an intermediate position.

The connecting device represented in FIG. 3 is in an intermediate position between the release position of FIG. 2 and a closed position illustrated hereinafter.

Herein the second part 3, which is capable of being pivoted about the axis of rotation 7, is pivoted toward the first part 1 through a remaining angle a', which is smaller than the angle a in the release position. In this intermediate position, the first connector 2 is already partially connected together with the second connector 4 by telescoping.

As in the release position illustrated in FIG. 2, the second part 3 bears with its contact surface 21 against the contact surface 22 of the pivotally mounted plate 9 and the connector 2 is in alignment with the second connector 4, as in the release position illustrated in FIG. 2.

Figure 4:
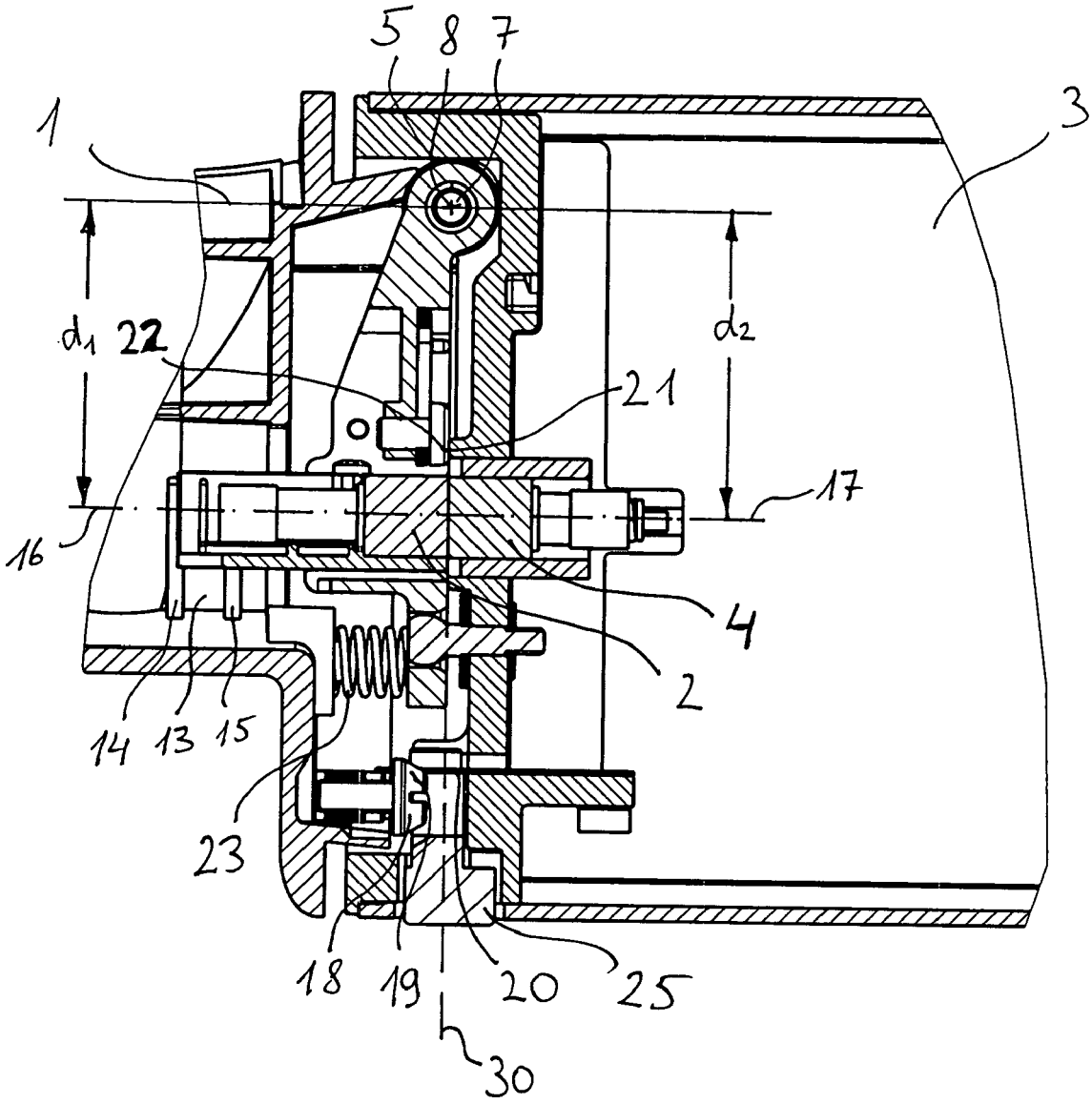
FIG. 4 shows the connecting device with of the two parts in a closed position.

In the connecting device represented in FIG. 4, the first part 1 and the second part 3 are in a closed position. The second part 3 is completely pivoted toward the first part 1. In this closed position, the first connector 2 is connected together with the second connector 4 by telescoping, as in the aforementioned manner.

On reaching the closed position, the locking bolt 18 engages in the opening 19 on the locking plate 20 on the second part 3 and prevents the second part 3 from pivoting back about the axis of rotation 7. The force on the locking plate 20 thus acts against the spring tension of the spring element 23.

To disengage the lock, an unlocking button 25 is actuated, which elastically bends the locking plate 20 so that the locking bolt18 disengages from the locking plate20.

As in the release and intermediate positions, the second part 3 bears via its contact surface 21 against the contact surface 22 of the pivotally mounted plate 9.

It can be seen with particular clarity that the positive guide 13 is linear and comprises two ribs 14 and 15, which are parallel to a connecting plane 30 in the closed position.

The second connector 4 is moved toward the first connector 2 after the plate 9 is pivoted from the release position to the closed position. The first connector 2 always aligns with the second connector 4, as in the removal and intermediate positions.

Figure 5:
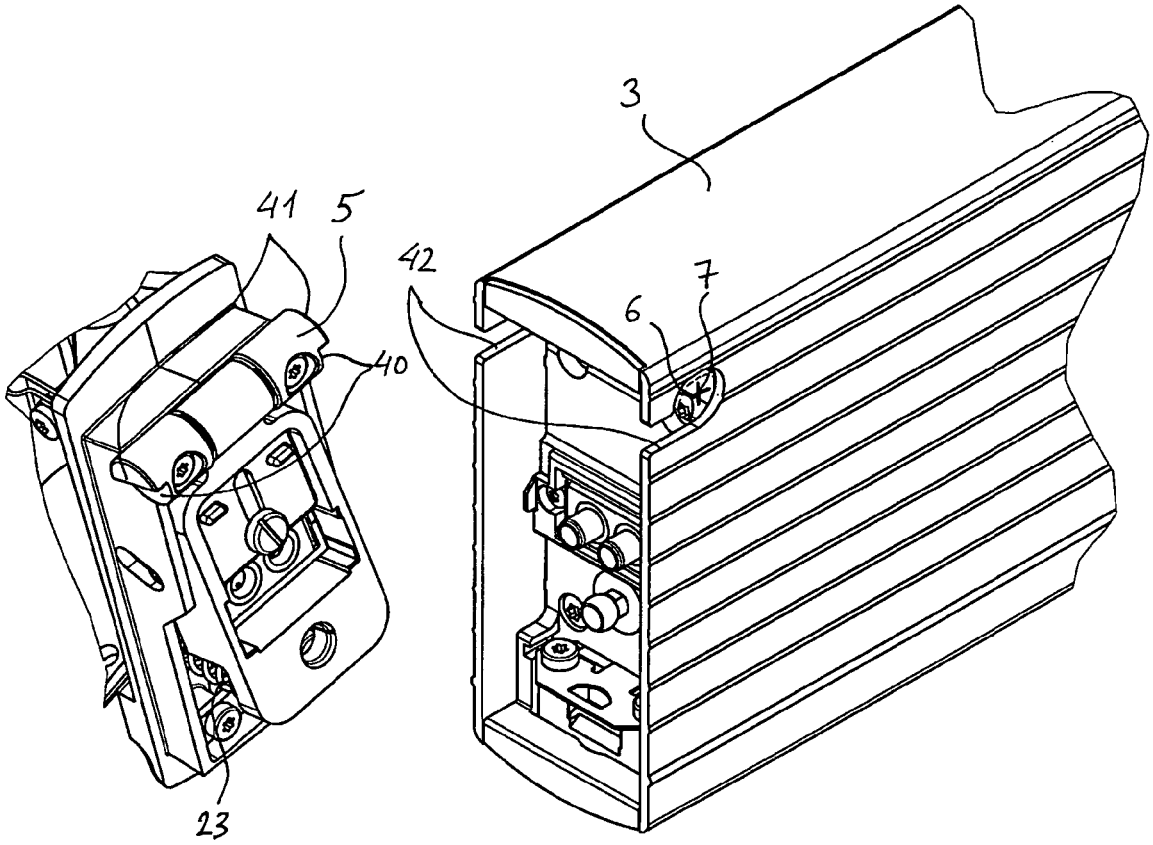
FIG. 5 shows a perspective view of the two parts of the connecting device in the separated state.

A perspective drawing of the first part 1 and the second part 3 is represented in FIG. 5. In the plugged state, the second part 3 is secured against falling out because the lower semicircle 40 on the two ends of the axle pin 5 is recessed, and the remaining upper semicircle 41 is inserted into the axle bearing 6 along a longitudinal groove 42, said longitudinal groove being narrower than the diameter of said axle pin, and is hooked therein due to the weight of the second part, which is pushed downwardly, thus forming a form fit with the upper part of the axle bearing being in the form of a segment of a circle. The consequence of this form fit is that the spring tension of the spring element 23 does not cause the second part to fall out of the axle bearing 6 as it pivots about the axis of rotation 7.

Figure 6:
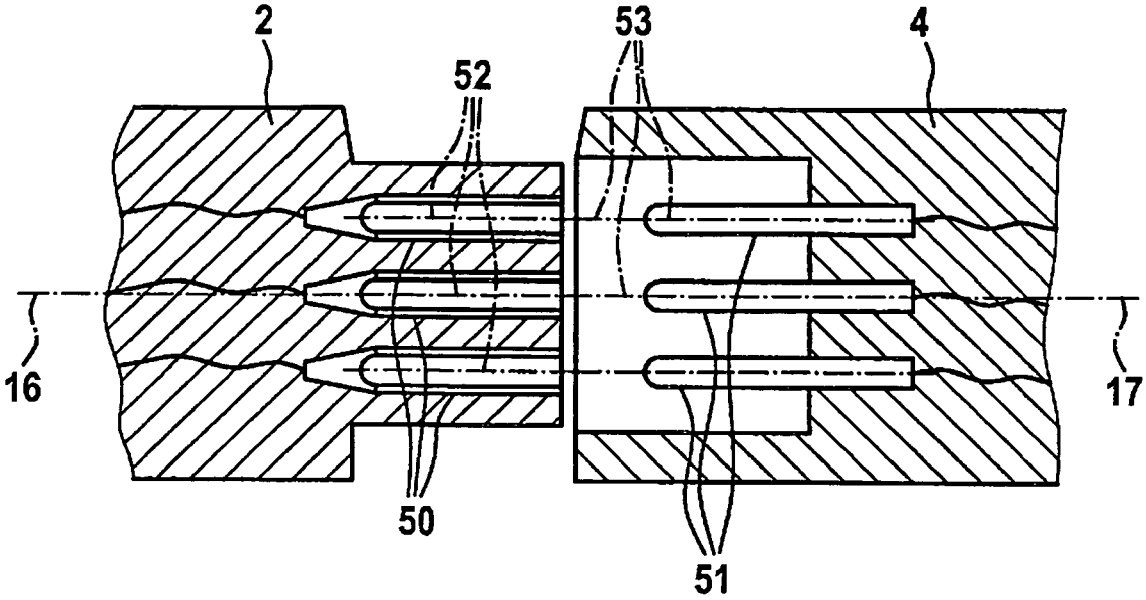
FIG. 6 shows an exemplary embodiment of connectors in the form of an electrical plug-and-socket connection.

An exemplary embodiment of the connectors as electrical plug-and-socket connections is represented in FIG. 6. The first connector 2 comprises a plurality of sockets 50 and the second connector 4 comprises a plurality of plugs 51. As the connecting device is pivoted from the release position to the closed position, the sockets 50 and the plugs 51 are connected together until they overlap as desired, thereby ensuring good contact. In all pivoted positions of the connecting device, the center axes 52 of the sockets 50 coincide with the respective center axes 53 of the plug 51, because the center axes 16 and 17 of the two connectors coincide. The plugs are thus prevented from being bent while they are being connected.

Figure 7:
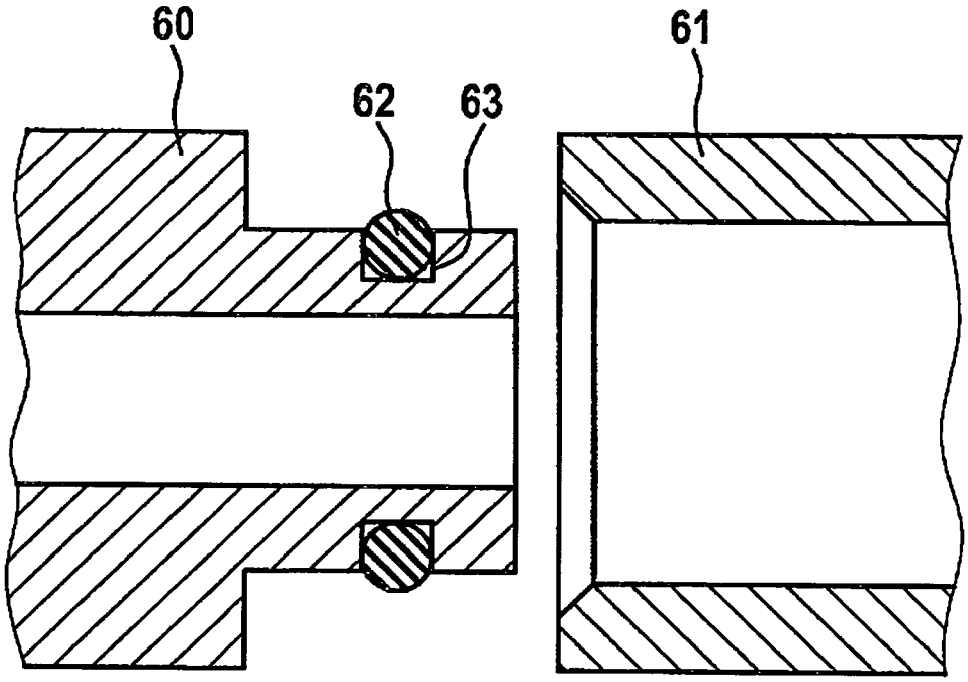
FIG. 7 shows an exemplary embodiment of connectors in the form of a sliding socket joint for pipes for transporting gases or liquids.

An exemplary embodiment of the connectors as a sliding socket joint for pipes for transporting gases or liquids is represented in FIG. 7. The first connector 2 comprises a first pipe section 60 and the second connector 4 comprises a second pipe section 61. As the connecting device is pivoted from the release position to the closed position, the second pipe section 61 is connected onto the first pipe section 60, wherein a gasket 62 inserted in a groove 63 on said first pipe section 60 seals the interior volume of the two pipe sections from the environment, in the closed position. The pressure between the gasket 62 and the inner wall of the second pipe section 61 must be at least as high as the inside pressure exerted by the medium being transported.

Figure 8:
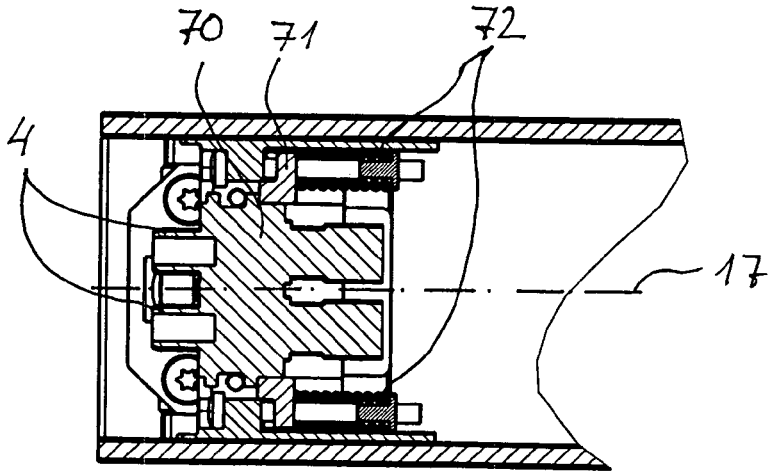
FIG. 8 shows a top view of a flexible connector in the form of a plug.

An exemplary embodiment of the second connector 4 as a flexible plug is represented in FIG. 8. The force exerted on the plug 70 along the center axis 17 is transferred to spring elements 72 via bearing pieces 71. The spring tension of the spring elements is thus many times higher than the friction generated during the connection of the two connectors 2 and 4.

This prevents the spring elements 72 from being compressed when the two connectors are being connected. The spring elements 72 should in fact not be compressed until there is a greater force along the center axis 17, which could occur, for example, if the plugs are in fact longer than intended.

The purpose of the flexible plug is to achieve a secure contact in the closed position, even for plugs with standard manufacturing tolerances.

Figure 9:
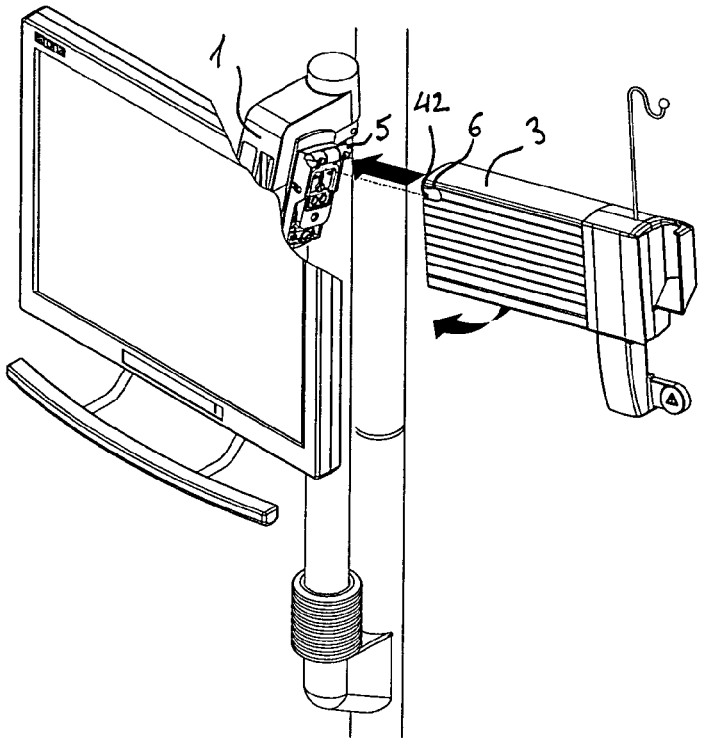
FIG. 9 shows an exemplary embodiment of the connecting device in the separated state, wherein the first part is a dental treatment center and the second part is a removable accessory device.

An exemplary embodiment of the connecting device is represented in FIG. 9, wherein the first part 1 is a dental treatment center and the second part 3 is a removable accessory device. The sequence of movements necessary to join the two pieces is illustrated by the two arrows. First, the second part 3 is linearly displaced toward the first part 1 so that the axle pin 5 is inserted along the longitudinal groove 42 into the axle bearing 6. Then the second part 3 is pivoted downwardly from the release position to the closed position.

Figure 10:
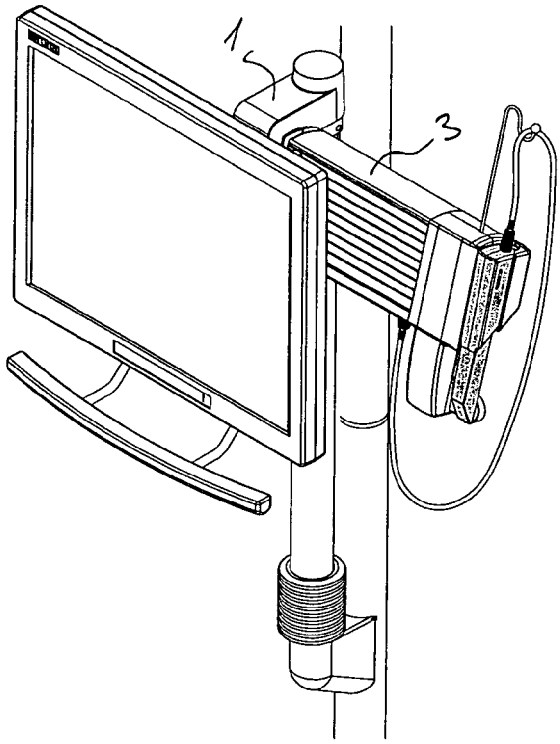
FIG. 10 shows an exemplary embodiment of the connecting device in the plugged state, wherein the first part is a dental treatment center and the second part is a removable accessory device.

The exemplary embodiment of FIG. 9 is illustrated in FIG. 10 in the plugged state. The second part 3 is in the closed position and is secured by locking.

LIST OF PARTS AND THEIR REFERENCE NUMBERS

1 first part
2 first connector
3 second part
4 second connector
5 axle pin
6 axle bearing
7 axis of rotation
8 center axis of the axle pin 5
9 plate
10 rotation stop
11 longitudinal guide
12 guide pin
13 positive guide
14 first rib of the positive guide 13
15 second rib of the positive guide 13
16 center axis of the first connector 2
17 center axis of the second connector 4
18 locking bolt
19 opening in the locking plate
20 locking plate
21 contact surface on the second part 3
22 contact surface on the plate 9
23 spring element
24 bearing piece
25 unlocking button
30 connecting plane in the closed position
40 detached lower semicircle on the end of the axle pin 8
41 remaining upper semicircle on the end of the axle pin 8
42 longitudinal groove
50 sockets
51 plugs
52 center axes of the sockets 50
53 center axes of the plugs 51
60 first pipe section
61 second pipe section
62 gasket
63 groove for the gasket 62
70 plug
71 bearing pieces
72 spring elements
a angle between the plate 9 and the first part 1 in the release position
a' angle between the plate 9 and the first part 1 in the intermediate position
d1 distance of the center axis 16 from the center axis 8 of the axle pin 5
d2 distance of the center axis 17 from the axis of rotation 7
S insertion distance

The invention claimed is:

1. A connecting device for a plug-and-socket connection including two connectors, comprising a first part (1) with a first connector (2) and a second part (3) with a second connector (4), wherein said first part (1) is equipped with an axle pin (5) having a center axis (8) and said second part (3) has an axle bearing (6) for said axle pin (5), which said second part (3) is pivotable from a release position to a closed position about an axis of rotation (7) defined by said axle bearing (6), wherein said first part (1) comprises a plate (9) pivoted about said center axis of the axle pin (8), at least some regions of the second part (3) bearing against the plate, and the first connector (2) is, on the one hand, longitudinally displaceable along a center axis (16) thereof relatively to said plate (9) by means of a longitudinal guide (11), and, on the other hand, is subjected to compelled guidance by a positive guide (13) on the first part (1), which said positive guide (13) is configured such that the first connector (2) remains substantially stationary relative to the first part (1) as the plate (9) is pivoted from the release position to the closed position, wherein a distance (d1)of said center axis (16) of said first connector (2) from the center axis of the axle pin (8) is equal to a distance (d2) of a center axis (17) of said second connector (4) from said axis of rotation (7).

2. A connecting device as defined in claim 1, wherein the connectors (2, 4) are electrical contacts (50, 51).

3. A connecting device as defined in claim 1, wherein the connectors (2, 4) are in the form of pipe sections (60, 61) for conducting gases or liquids.

4. A connecting device as defined in claim 1, wherein the first part (1) is a fixed part and the second part (3) is a removable part, or vice versa.

5. A connecting device as defined in claim 1, wherein the first part (1) is a dental treatment center and the second part (3) is a removable accessory device.

6. A connecting device as defined in claim 1, wherein the second part (3) is secured against falling out in all intermediate positions between the release position and the closed position in that a lower semicircle (40) of the axle pin (5) is recessed such that a remaining upper semicircle (41) is inserted along a longitudinal groove (42) in the axle bearing (6) and is hooked therein due to the weight of the second part (2), which is pushed downwardly, thus forming a form fit with an upper part of the axle bearing (6) in the form of a segment of a circle.

7. A connecting device as defined in claim 1, wherein said plate (9) is braced against the first part (1) by a biased spring element (23).

8. A connecting device as defined in claim 1, wherein a rotation stop (10) is provided for the pivoting of the plate (9) toward the second part (1), said stop being configured such that in the release position, the plate (9) being pivoted by not more than an angle a.

9. A connecting device as defined in claim 1, wherein the axis of rotation (7) is eccentrically located relative to the center axes (16, 17) of the two connectors (2, 4).

10. A connecting device as defined in claim 1, wherein a locking means (18, 19, 20) is provided which prevents the second part (3) from pivoting back when the closed position is attained.

11. A connecting device as defined in claim 7, wherein spring tension of the spring element (23) is such that said plate (9) pivots through the angle a from the closed position to the release position.

12. A connecting device for a plug-and-socket connection which comprises:

a first part which includes a frame member that defines an axle pin having a first center axis, positive guide elements, and a plate member which is pivotably mounted to said axle pin so as to be pivotable between a release position and a closed position, said plate member including a first contact surface and a longitudinal guide element, said plate member mounting a first connector which defines a first longitudinal axis and is movable along said first longitudinal axis and guided by said positive guide elements and said longitudinal guide element to remain in a substantially fixed special relation to said frame member as said plate member moves between said release and closed positions, and a second part which includes an axle bearing having a second center axis, a second contact surface, and a second connector which defines a second longitudinal axis, said axle bearing being mountable on said axle pin so that when said second part is pivoted toward said first part from the release position to the closed position, said second contact surface will contact said first contact surface, said second connector will contact said first connector, and said plate member will pivot about said axle pin from said release position to said closed position, a distance between said second longitudinal axis and said second center axis being equal to a distance between said first longitudinal axis and said first center axis.

* * * * *